US006280217B1

(12) United States Patent
Lin

(10) Patent No.: US 6,280,217 B1
(45) Date of Patent: Aug. 28, 2001

(54) ZERO INSERTION FORCE CONNECTOR

(75) Inventor: Yi Yan Lin, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/518,002

(22) Filed: Mar. 2, 2000

(30) Foreign Application Priority Data

Feb. 2, 2000 (TW) ..... 89201917

(51) Int. Cl.[7] ..... H01R 13/15
(52) U.S. Cl. ..... 439/260; 439/495
(58) Field of Search ..... 439/260, 495, 439/329, 67

(56) References Cited

U.S. PATENT DOCUMENTS 4,778,403 * 10/1988 Ikesugi et al. ..... 439/329
5,458,506 * 10/1995 Yamaguchi et al. ..... 439/495
5,580,272 * 12/1996 Yamaguchi et al. ..... 439/495
5,904,586 * 5/1999 Takayasu ..... 439/260
6,056,572 * 5/2000 Matsumoto et al. ..... 439/260

* cited by examiner

*Primary Examiner*—Gary F. Paumen
(74) *Attorney, Agent, or Firm*—Wei Te Chung

(57) ABSTRACT

A ZIF connector comprises an insulative housing, a plurality of terminals received in the housing, an insulative cover plate curvedly slidably mounted on the housing having a pressing plate for pressing an FPC against the terminals, an actuation mechanism for curvedly slidably connecting the cover plate and the housing and two locking mechanisms for securely locking the cover plate to the housing. The housing comprises a pair of standing walls at both ends thereof. The cover plate comprises a pair of arms formed at opposite ends thereof. The actuation mechanism comprises a pair of arcuate channels defined in the two standing walls and a pair of corresponding arcuate ribs formed on opposite arms of the cover plate and slidingly moveable in the arcuate channels when the cover plate is curvedly slidably moved relative to the housing.

1 Claim, 5 Drawing Sheets

ZERO INSERTION FORCE CONNECTOR

BACKGROUND OF THE INVENTION

The present invention relates to a zero insertion force (ZIF) connector.

In order to facilitate electrical connection between a conductor such as a flexible printed circuit (FPC) and an element such as a printed circuit board (PCB), a zero insertion force connector can be used. U.S. Pat. Nos. 4,778,403; 5,458,506 and 5,580,272 disclose a series of ZIF connectors. The conventional connectors each have an insulative housing and a cover plate connected with the housing. The connector is provided with a pivoting mechanism respectively formed on the housing and the cover plate, whereby the cover plate is pivotable relative to the housing between closed and open positions. However, due to limited space in the connector, the pivot mechanism must have a small size, which causes the mechanism to be weak by nature. The weak pivot mechanism impairs the durability of the connector. Referring to FIG. 5 which is a duplication of FIG. 3 in U.S. Pat. No. 4,778,403, a ZIF connector comprises an insulative housing 72 and a cover plate 76 pivotably attached to the housing 72. The housing 72 comprises a pair of reversed steps 720 at a front end thereof and the cover plate 76 comprises a pair of projection shoulders 760 at a front end thereof. The cover plate 76 further comprises a pair of side walls 762 clamping both ends 722 of the housing 72 therebetween. The side walls 762 can become unhinged due to the cover plate 76 simultaneously clamping with the housing 72 at its forward end and pivoting about the housing 72 at its middle. This can happen while attempting to fully close the cover plate 76 with the housing 72. As the cover plate 76 pivots it can simultaneously move forward, thereby causing the side walls 762 to disengage from the housing 72. Additionally, the projection shoulder 760 is not durable and is prone to being deformed and broken when the projection shoulder 760 engages with the reversed step 720 of the housing 72. Hence, an improved ZIF connector is required to overcome the disadvantages of the prior art.

SUMMARY OF THE INVENTION

Accordingly, a first object of the present invention is to provide a ZIF connector having a curvedly sliding mechanism for curvedly slidably connecting a cover plate and an insulative housing thereby facilitating inserting or removing an FPC when the cover plate is in an open position.

A second object of the present invention is to provide a ZIF connector having two locking mechanisms thereby providing secure retention between the housing and the cover plate.

Accordingly, a ZIF connector comprises an insulative housing, a plurality of terminals received in the housing, a cover plate mounted to the housing for pressing an FPC against the terminals, a curvedly sliding mechanism for curvedly slidably connecting the cover plate with the housing, and two locking mechanisms for securely locking the cover plate to the housing.

The housing comprises a top wall, a bottom wall and a pair of standing walls vertically extending from opposite ends of the bottom wall. The terminals each comprise an upper portion and a lower portion which respectively fit in a lower face of the top wall and in an upper face of the bottom wall. The top wall and the bottom wall define a space therebetween. The cover plate comprises a main body, a pair of arms formed at opposite ends of the main body and a pressing plate projecting from the main body into the space between the upper portions and the lower portions of the terminals. The curvedly sliding mechanism comprises a pair of arcuate channels defined in the two standing walls and a pair of corresponding arcuate ribs formed on opposite arms of the cover plate and slidingly moving in the arcuate channels.

Other objects, advantages and novel features of the invention will become more apparent from the following detailed description when taken in conjunction with the accompanying drawings.

DETAILED DESCRIPTION OF A PREFERRED EMBODIMENT

Figure 1:
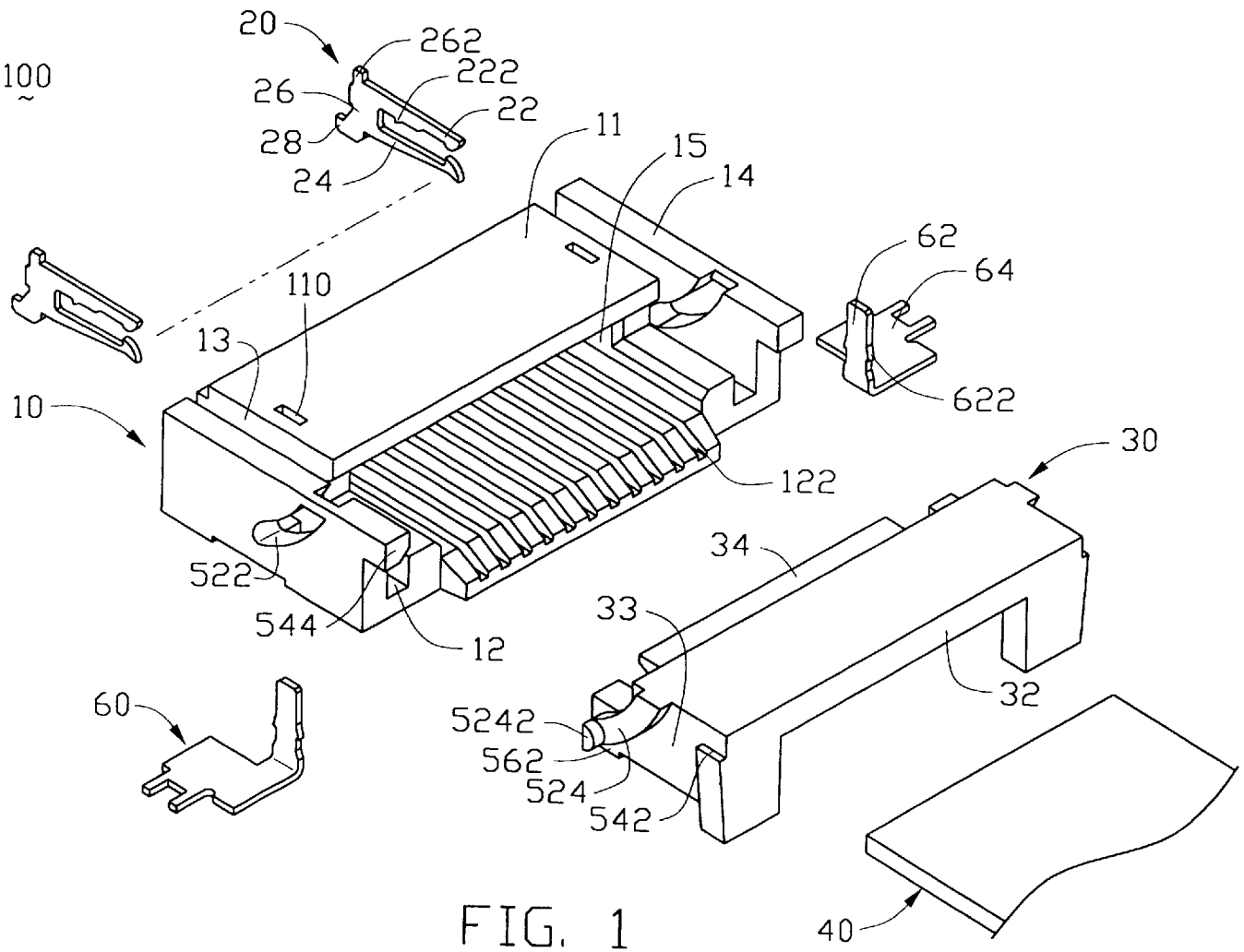
FIG. 1 is an exploded view of a ZIF connector for connecting with a flexible printed circuit (FPC) in accordance with the present invention.

Referring to FIG. 1, a ZIF connector 100 comprises an elongate insulative housing 10, a plurality of terminals 20 (only two shown), a cover plate 30 and a pair of metal hold-downs 60. The housing 10 and cover plate 30 taken in combination further comprise an actuation mechanism 52, a first locking mechanism 54 and a second locking mechanism 56.

Figure 3:
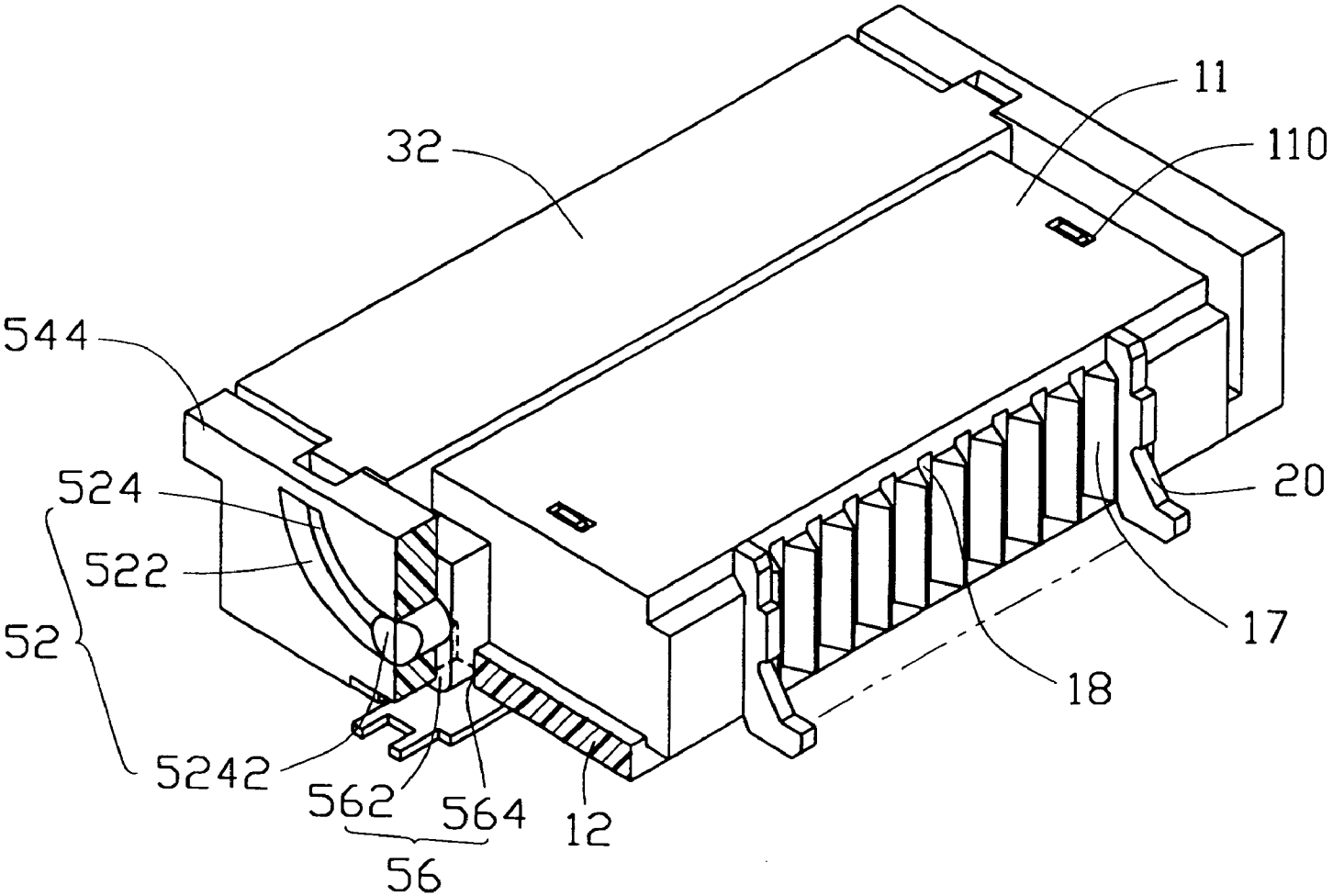
FIG. 3 is a rear perspective view partially in section of the ZIF connector wherein a standing wall and a bottom wall of the connector are partially removed and the cover plate is in a closed position.
Figure 4:
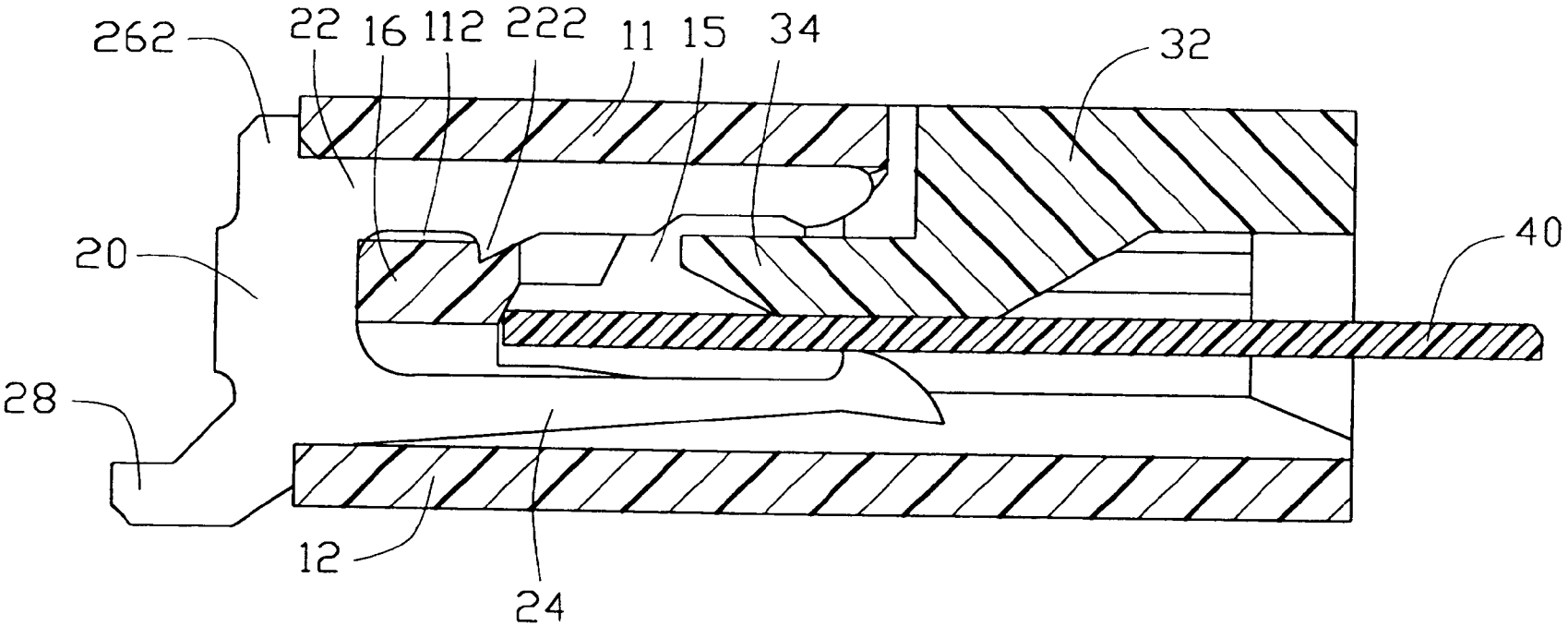
FIG. 4 is a cross-sectional view of the ZIF connector with the FPC inserted in the connector.
Figure 5:
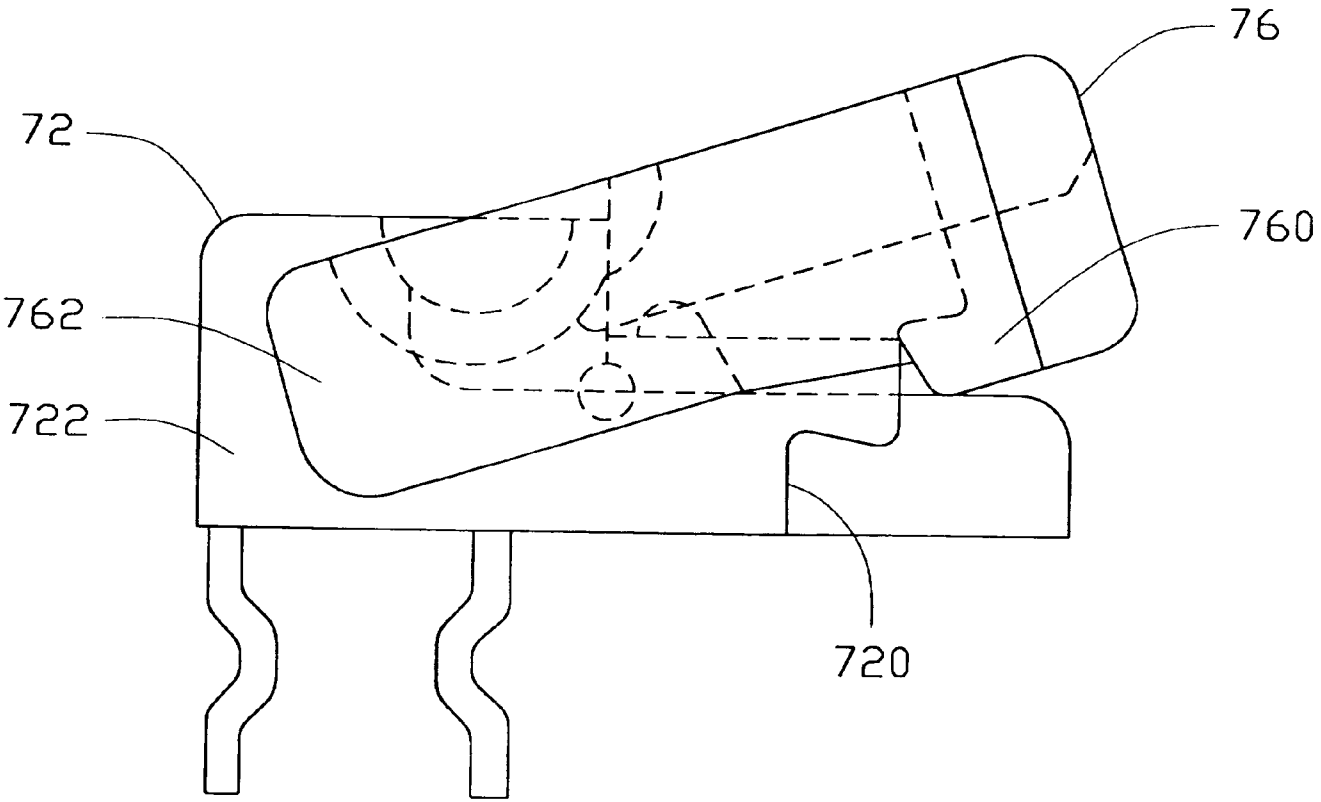
FIG. 5 (PRIOR ART)
FIG. 5 is a side view of a conventional connector.

The insulative housing 10 comprises a top wall 11, a bottom wall 12, two side walls 13 and a pair of standing walls 14 vertically extending from opposite ends of the bottom wall 12, parallel and spaced apart from corresponding side walls 13, respectively. The top wall 11, the bottom wall 12 and the two side walls 13 together define a space 15. A pair of slots 110 vertically extends through the side walls 13 for interferentially fitting with vertical portions 62 of the pair of metal hold-downs 60. Referring to FIGS. 1, 3 and 4, a plurality of upper passageways 112 and lower passageways 122 are respectively defined in a lower face of the top wall 11 and in an upper face of the bottom wall 12. A beam 16 is formed within the housing 10 located in a rear portion of the space 15 between the upper and lower passageways 112, 122. The housing 10 forms a plurality of ridges 17 at a rear end of the housing 10 between the top wall 11 and the bottom wall 12 and connecting with the beam 16. A split 18 is defined between every two ridges 17 and in communication with corresponding upper and lower passageways 112, 122 for extension of a corresponding terminal 20 therethrough to be received in the corresponding upper and lower passageways 112,122.

Each terminal 20 comprises an upper portion 22, a lower portion 24, a connecting portion 26 connecting with the upper portion 22 and the lower portion 24 and a soldering portion 28 extending from the connecting portion 26 for soldering to a printed circuit board (not shown). The upper portion 22 forms an interfering portion 222 for interferentially engaging with the housing 10. The connecting portion 26 forms a tab 262 extending upwardly beyond the upper portion 22.

The cover plate 30 comprises a main body 32, a pair of arms 33 formed at opposite ends of the main body 32 and a pressing plate 34 projecting rearward from the main body 32 for being inserted into the space 15 of the housing 10.

Figure 2:
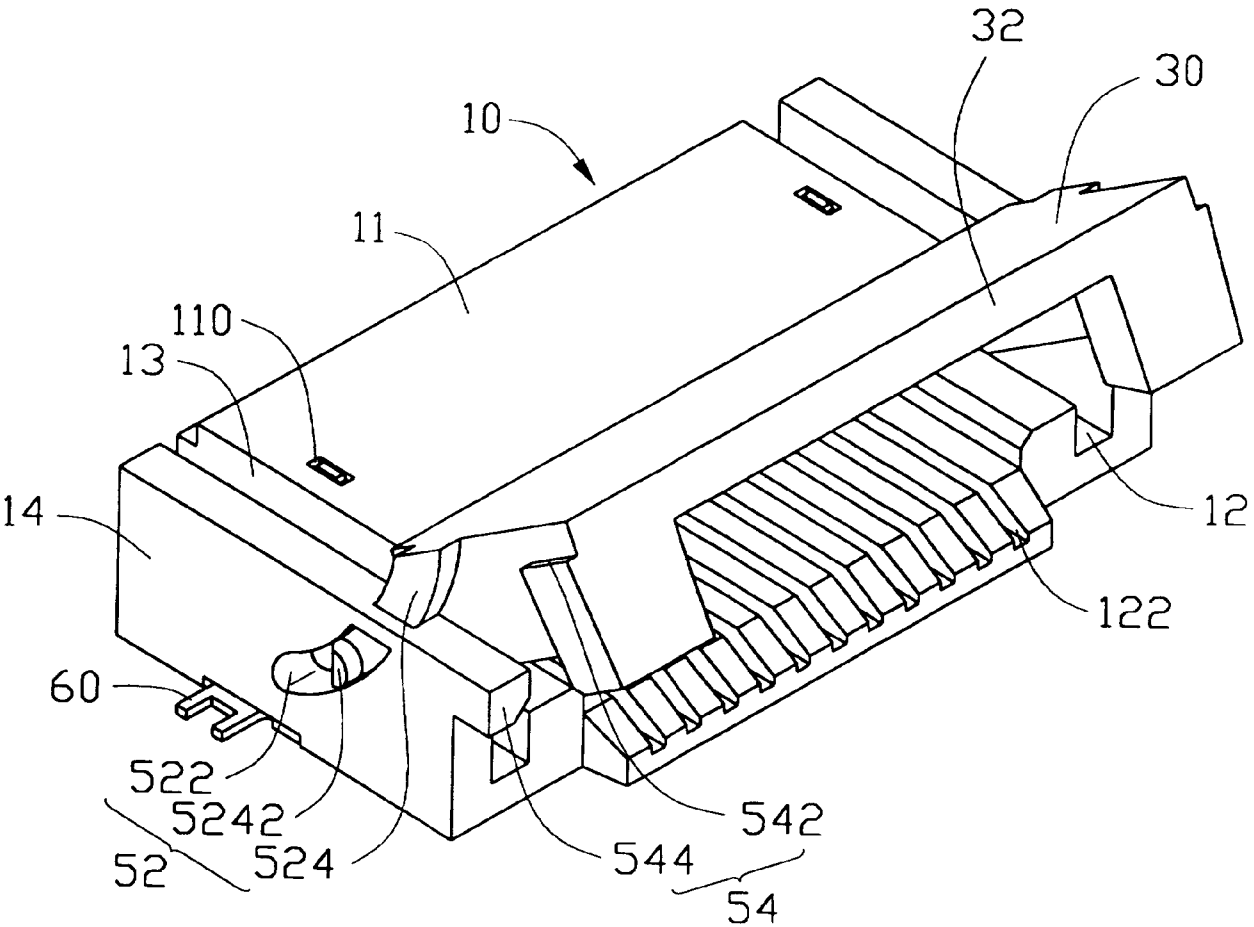
FIG. 2 is an assembled view of FIG. 1 with the cover plate in an open position.

Referring to FIG. 1, FIG. 2 and FIG. 3, the curvedly sliding mechanism 52 comprises a pair of arcuate channels 522 defined in the two standing walls 14, respectively, and a pair of corresponding arcuate ribs 524 formed on both arms 33 of the cover plate 30, respectively. The arcuate ribs 524 can be curvedly slidably received in the arcuate channels 522. Each rib 524 forms a projection 5242 for projecting into the arcuate channel 522 of the standing wall 14.

The first locking mechanism 54 comprises a pair of trapeziform portions 542 at opposite front ends of the main body 32 and a pair of stops 544 formed at corresponding ends of the standing walls 14. The trapeziform portions 542 can be locked under the stops 544 when the cover plate 30 is operated in a closed position. The second locking mechanism 56 comprises a pair of protrusions 562 formed at a rear bottom of the arms 33 of the cover plate 30 and a pair of apertures 564 defined in the bottom wall 12 between the side walls 13 and the standing walls 14 of the housing 10. The protrusions 562 can be securely inserted into the apertures 564 when the cover plate 30 is engaged in a closed position.

Referring to FIG. 1, each metal hold-down 60 comprises a vertical portion 62 for inserting in the housing 10 and a horizontal portion 64 for soldering to the printed circuit board. A pair of barbs 622 extends from opposite edges of the vertical portion 62.

In assembly, each terminal 20 is inserted into the housing 10 from the split 18 of the housing 10. The upper portion 22 is received into the upper passageway 112 and the lower portion 24 is received into the lower passageway 122. The interfering portions 222 interferingly engage with the beam 16 of the housing 10 and the tabs 262 abut against the upper wall 11 of the housing 10 whereby the terminal 20 is positioned in the housing. The vertical portions 62 of the two metal hold-downs 60 are inserted into the slots 110 of the housing 10 from the bottom wall 12. The barbs 622 interfere with inner walls of the slots 110 whereby the metal hold-downs 60 are secured in the slots 110.

When the cover plate 30 is assembled to the housing 10, first, the stops 544 of the standing walls 14 of the housing 10 are moved outwardly. The projections 5242 of the arcuate ribs 524 of the cover plate 30 are aligned with then inserted into both upper ends of the arcuate channels 522 of the standing walls 14. The FPC 40 is inserted into the space 15 between the upper portions 22 and the lower portions 24 of the terminals 20. Second, the arcuate ribs 524 and the projections 5242 slide along the arcuate channels 522 and the pressing plate 34 is gradually inserted into the space 15 between the upper portions 22 of the terminals 20 and the FPC 40. Finally, the projections 5242 contact with both lower ends of the channels 522 and the pressing plate 34 presses the FPC 40 against the lower portions 24 of the terminals 20. In this position, the trapeziform portions 542 of the cover plate 30 lock under the stops 544 of the standing walls 14. The protrusions 562 of the arms 33 of the cover plate 30 are inserted into and are lockably positioned in the apertures 564 of the bottom wall 12 of the housing 10. Thus, the cover plate 30 is secured in a closed position. An electrical transmission path from the FPC 40 to the terminal 20 is established.

When the cover plate 30 is released from the housing 10, the stops 544 are moved outwardly, the trapeziform portions 542 disengage from the stops 544 and the protrusions 562 withdrew from the apertures 564, then the cover plate 30 slides away from the housing 10. The two projections 5242 are stopped at both upper ends of the arcuate channels 522. The FPC 40 can then be extracted from the ZIF connector 100.

It can be appreciated that the cover plate 30 is optionally not a pure rotation movement about a single pivot with regard to the housing 10 as shown in the prior art, while being a compound path comprising both the rotating and the sliding movements which may be deemed curvedly sliding about more than one pivots, thereby being able to either avoid unexpected interfere between the cover plate 30 and the housing 10, or enhance the desired engagement among the cover plate 30, and the housing 10 and the inserted FPC 40 therebetween for wiping action consideration during the assembling procedure.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing, comprising a top wall, a bottom wall, a pair of standing walls vertically extending from opposite ends of the bottom wall, the top wall and the bottom wall together defining a space therebetween, a plurality of upper passageways defined in a lower surface of the top wall and a plurality of lower passageways defined in an upper surface of the bottom wall;

a plurality of terminals each comprising an upper portion received in the corresponding upper passageway and a lower portion received in the corresponding lower passageway;

an insulative cover plate curvedly slidably mounted on the housing comprising a main body and a pressing plate projecting from the main body into the space between the upper portions and the lower portions of the terminals for urging a flexible printed circuit inserted into the space against the lower portions of the terminals; and means for curvedly slidably connecting the cover plate to the housing, comprising a pair of channels defined in the two standing walls and a pair of corresponding ribs formed on the main body of the cover plate and slidingly moving in the channels when the cover plate is curvedly slidably moved relative to the housing;

wherein the channels are arcuate and the ribs are also arcuate;

wherein projections are formed at an end of the ribs for being stopped at both upper ends of the arcuate channels of the cover plate to prevent the cover plate from disconnecting from the housing;

wherein a pair of arms is formed at opposite ends of the main body and the ribs are formed on the arms;

wherein the housing further comprises a pair of side walls, the space is defined together by the top wall, bottom wall and the side walls, and the standing walls are spaced a distance apart from the corresponding side walls;

wherein the connector further comprises a first locking mechanism and'the first locking mechanism comprises a pair of trapeziform portions at both front ends of the main body and a pair of corresponding stops at opposite front ends of the standing walls, the trapeziform portions locking under the stops when the cover plate is secured in a closed position;

wherein the connector further comprises a second locking mechanism and the second locking mechanism comprises a pair of protrusions formed at a bottom of the arms and a pair of apertures defined in the bottom wall, and the protrusions are securely inserted into the apertures when the cover plate is secured in a closed position;

wherein the connector further comprises a pair of metal hold-downs, each metal hold-down comprising a vertical portion and a horizontal portion for soldering to a printed circuit board, the side walls of the housing defining a pair of vertical slots, the vertical portions of the metal hold-downs being inserted and secured in the slots.

* * * * *